US005784895A

United States Patent [19]

Choi

[11] Patent Number: 5,784,895

[45] Date of Patent: Jul. 28, 1998

[54] REFRIGERATOR WITH AN AIR CURTAIN GENERATOR

[75] Inventor: Young-Houn Choi, Pucheon, Rep. of Korea

[73] Assignee: Daewoo Electronics Co., Ltd., Seoul, Rep. of Korea

[21] Appl. No.: 826,578

[22] Filed: Apr. 3, 1997

[51] Int. Cl.[6] ..... F25D 17/04

[52] U.S. Cl. ..... 62/407; 62/419; 62/441; 62/256

[58] Field of Search ..... 62/256, 404, 407, 62/408, 419, 441

[56] References Cited

U.S. PATENT DOCUMENTS

| | | | |
|---|---|---|---|
| 2,794,325 | 6/1957 | Shearer | 62/419 |
| 2,926,507 | 3/1960 | Ingolia | 62/419 |
| 4,058,989 | 11/1977 | Horvay et al. | 62/256 |
| 4,210,000 | 7/1980 | Lee | 62/417 |
| 4,379,391 | 4/1983 | Rhee | 62/408 |

FOREIGN PATENT DOCUMENTS

| | | | |
|---|---|---|---|
| 197783 | 8/1990 | Japan | 62/405 |

*Primary Examiner*—William Doerrler
*Attorney, Agent, or Firm*—Jacobson, Price, Holman & Stern, PLLC

[57] ABSTRACT

A refrigerator provided with an air curtain generator in a refrigerating room is disclosed. A supply duct for an air curtain is installed at the uppermost portion of the refrigerating room. A crossflow fan is provided within the supply duct, and a supply port is formed at a terminal end of the supply duct adjacent to a door for the refrigerating room. The supply port is slit-shaped and extends along a width direction of the refrigerating room. At least one step is provided on a lower surface of the inside of the supply duct. The supply duct is communicated with a suction duct constituting a cooling system of the refrigerator. When the door is opened, the air curtain is formed over the open side of the refrigerating room to block the invasion of the surrounding air.

24 Claims, 5 Drawing Sheets

REFRIGERATOR WITH AN AIR CURTAIN GENERATOR

BACKGROUND OF THE INVENTION

1. Field of the Invention

The present invention relates to a refrigerator, and more particularly to a refrigerator which adopts an air curtain to prevent cool air stored within a refrigerating room from flowing out when a door for the refrigerating room opens.

2. Description of the Prior Art

Generally, as shown in FIG. 5, a refrigerator is divided into a freezing room 100 and a refrigerating room 200. A compressor 10 for compressing a refrigerant is installed on the bottom of the refrigerator, while an evaporator 20 is installed at a back side of freezing room 100. The refrigerant which is compressed by compressor 10 is circulated, and evaporator 20 cools surrounding air with the action of the circulating refrigerant. The cool air which is cooled by evaporator 20 is supplied to freezing room 100 and refrigerating room 200 through a feeding duct for feeding the cool air. A suction duct 30 through which the cool air is sucked is formed between freezing room 100 and refrigerating room 200 and is communicated with freezing room 100 and refrigerating room 200 and evaporator 20. Suction duct 30 is divided by a frost adhesion plate 32 and extends to freezing room 100 and refrigerating room 200 to suck up warm air and send the warm air to evaporator 20. A fan 22 is installed at the upper portion of evaporator 20 to supply the cool air cooled through evaporator 20 to freezing room 100 and refrigerating room 200 through the feeding duct. A door 40 for freezing room 100 is installed at a front side of freezing room 100, and a door (not shown) for refrigerating room 200 is also installed at a front side of refrigerating room 200.

When the door for refrigerating room 200 is open, the outside air invades into refrigerating room 200 because of the temperature difference between the inside and outside of refrigerating room 200 as shown with blank arrows in FIG. 5. Then, the cool air within refrigerating room 200 moves downward, i.e., toward shelves 34, 35 and 36, and flows out of the refrigerator along the elliptical trace as shown with solid arrows in FIG. 5. This is a spontaneous convection phenomenon and continues until the inside temperature of refrigerating room 200 is equal to the outside temperature thereof under the open condition of the door for refrigerating room 200.

FIG. 6 is a graph showing the relationship between the door opening time and the temperature of the refrigerating room in the conventional refrigerator, wherein A shows the temperature change in an upper accommodating space located above shelf 34, B in a middle accommodating space located above shelf 35, and C in a lower accommodating space located above shelf 36. As shown, the temperature of refrigerating room 200 is abruptly increased in proportion to the opening time of the door therefor. Especially, the temperature of the upper accommodating space is almost equal to the outside temperature only about 10 seconds after opening the door for refrigerating room 200.

The raised temperature of refrigerating room 200 is not lowered rapidly in spite of closing of the door therefor, and further, a longer period is required in view of the temperature uniformity within refrigerating room 200. As a result, the preservation period of the food stored in the refrigerator is shortened.

To solve the problem, there have been many studies. As an alternative, an air curtain technique which was utilized in an open commercial show case has been adapted to the refrigerator in order to maintain the inside temperature. U.S. Pat. No. 5,048,303 to Campbell et al. discloses a typical open show case. However, it is difficult to adapt the air curtain technique to the refrigerator because of the following problems.

Firstly, the open show case includes an upper outlet for injecting air to form an air curtain and a lower inlet for sucking the injected air. To adapt the lower inlet to the refrigerator, an additional duct should be installed. Therefore, the manufacturing cost of the refrigerator is increased and the accommodating space of food is reduced.

Secondly, the cool air injected through the upper outlet in the open show case should serve for blocking of the outside air as well as cooling of the stored food. To enhance the blocking performance, it is required to continuously inject the cool air of high speed, while to enhance the cooling performance, it is required to intermittently control the injection of the cool air or to variably control the flow speed of the cool air injected. That is, the two requirements are in conflict with each other. To solve the problem, double air curtains or triple air curtains are utilized in the open show case. However, it is actually impossible to adopt the constitution in the refrigerator.

Thirdly, in the open show case, the divergence of the cool air injected and the generation of the turbulent flow within the case should be considered to cool the inside space of the case. In order to consider the matters, the lower inlet of the open show case is provided to be projected forwardly in comparison with the upper outlet, and inner shelves are installed to have a predetermined angle with respect to a horizontal plane. Actually, it is difficult to adopt the constitution in the refrigerator. Besides, the invasion of outside air into the refrigerating room can be promoted in the refrigerator because the injected cool air is diverged to be mixed with the outside air.

SUMMARY OF THE INVENTION

The present invention is intended to overcome the above problems of the conventional technique.

An object of the present invention is to provide a refrigerator adopting an air curtain without forming an additional suction port.

To achieve the object of the present invention, there is provided a refrigerator comprising:

a freezing room;

a refrigerating room;

producing means for producing cool air;

circulating means for circulating the cool air in the freezing room and the refrigerating room, including a feeding duct provided with at least one feeding port, a suction duct provided with at least one suction port which is formed at a rear side of the refrigerating room and a fan member; and generating means for generating an air curtain in the refrigerating room, the generating means comprising:

a supply duct for the air curtain, including a supply port installed adjacent to a door of the refrigerating room to downwardly inject air flows for the air curtain therethrough, being installed at an uppermost portion within the refrigerating room to extend from a rear portion of the refrigerating room to a front portion thereof, and being communicated with the suction duct, the supply port being of a slit shape extending along a width direction of the refrigerating room; and a fan member for the air curtain, installed within the supply duct to generate the air flows and being operated to be driven at the time of opening of the door and stop at the time of closing of the door.

Preferably, at least one shelf is installed in the refrigerating room, and the sectional area of the suction port allotted to the respective accommodating spaces which are divided by the shelf is determined so that the sectional area of the suction port allotted to a lower accommodating space is broader than that of the suction port allotted to an upper accommodating space.

The fan member for the air curtain is a crossflow fan, and the crossflow fan may have a length substantially equal to the inner width of the refrigerating room.

Preferably, the sectional area of the supply duct is gradually decreased toward the supply port from a portion of the supply duct receiving the fan member for the air curtain therein.

For example, the lower inclined flat portion is provided with at least one step thereon.

Further, a straight portion of the supply duct is formed to lean to the outside of the refrigerator by 5° to 20° with respect to a vertical line.

Preferably, a terminal end, adjacent to the door, of the lowest shelf installed within the refrigerating room is located to be projected from the installing position of the supply port toward the door, while terminal ends, adjacent to the door, of the other shelves are located to be retracted from the installing position into the refrigerating room.

BRIEF DESCRIPTION OF THE DRAWINGS

The above object and other advantages of the present invention will become more apparent by describing in detail preferable embodiments thereof with reference to the attached drawings in which.

DETAILED DESCRIPTION OF THE PREFERRED EMBODIMENT

Hereinafter, the preferred embodiment of the present invention will be described in detail with reference to FIGS. 1 to 3.

Figure 2:
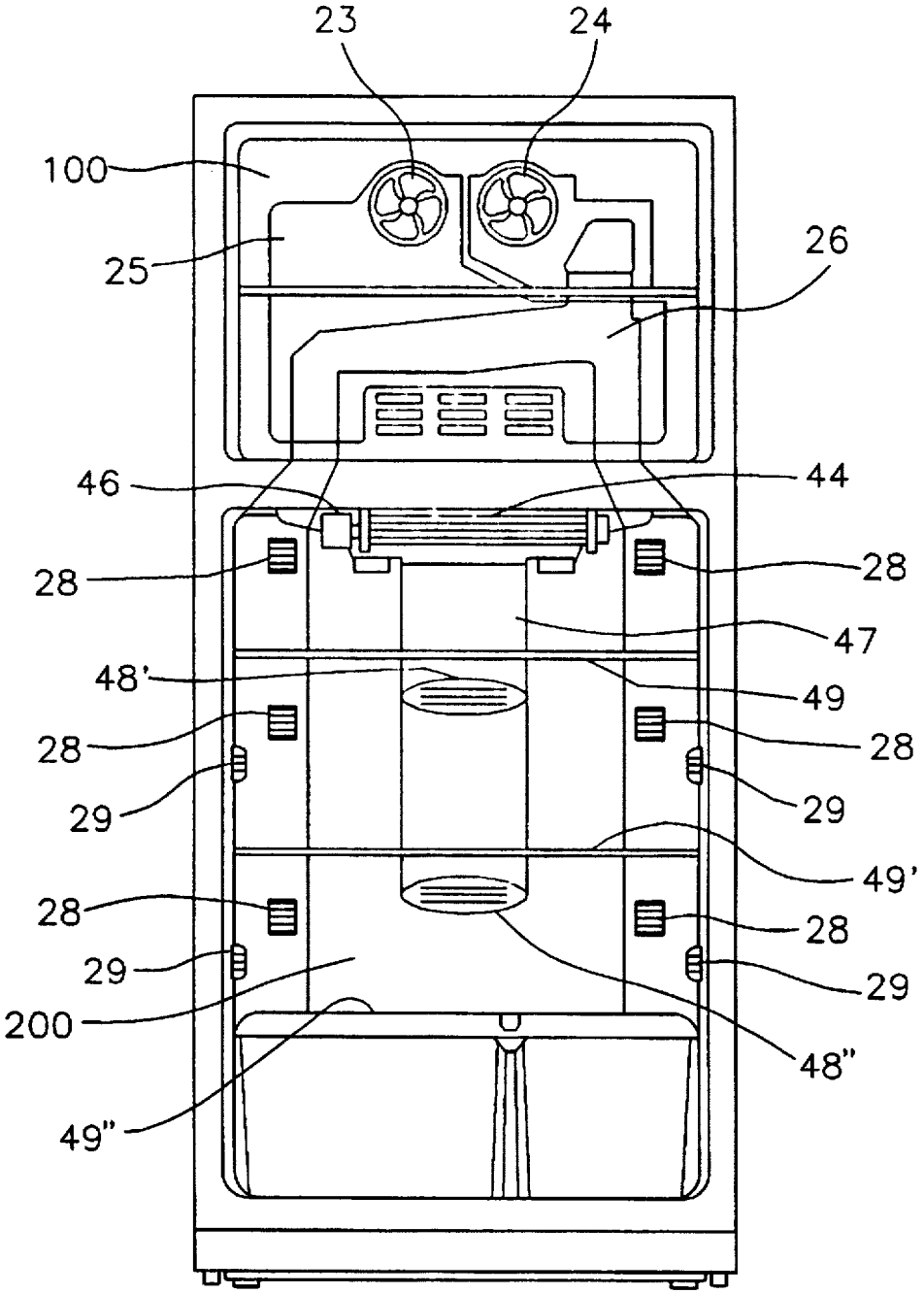
FIG. 2 is a front view showing the internal structure of the refrigerator according to the present invention, in which a crossflow fan and a motor are exposed.
Figure 3:
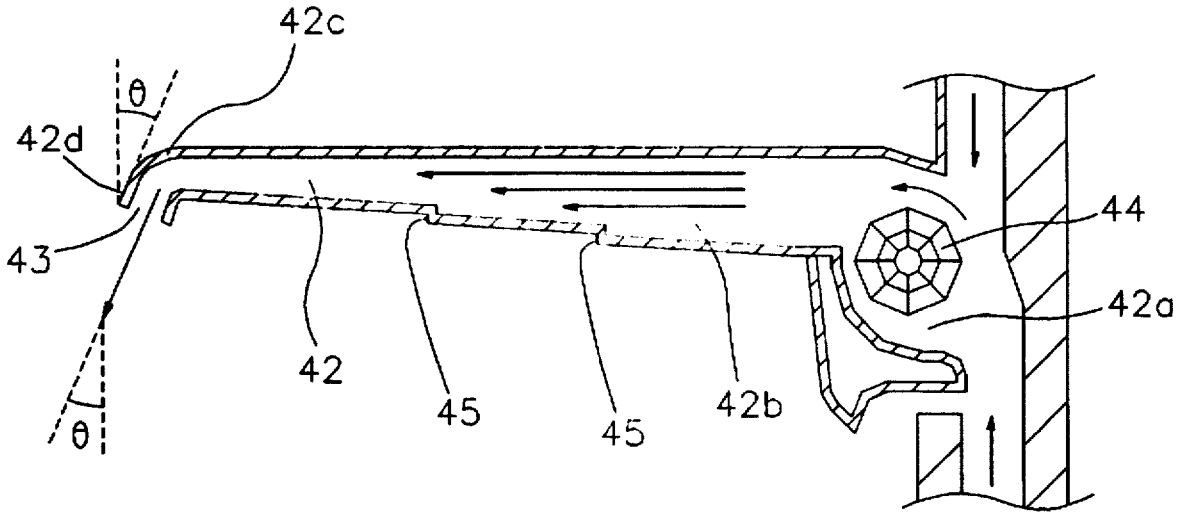
FIG. 3 is an enlarged sectional view of an air curtain generator as shown in FIG. 1.

In FIG. 2, a refrigerator is divided into a freezing room 100 and a refrigerating room 200. A compressor 10 installed on the bottom of the refrigerator compresses a refrigerant and circulates it to an evaporator 20 installed at a rear portion of freezing room 100. Evaporator 20 cools surrounding air through the evaporation of the circulated refrigerant.

Fans 23 and 24 for supplying cool air are installed at a rear portion of freezing room 100 and supply the cool air cooled by evaporator 20 to freezing room 100 and refrigerating room 200 through feeding ducts 25 and 26, respectively. Feeding duct 25 is installed at a rear portion of freezing room 100, and the cool air which flows into feeding duct 25 through fan 23 is supplied into freezing room 100 through a feeding port 27. Feeding duct 26 is installed at a rear portion of the refrigerator and preferably, is divided into two ducts to extend along the two corners at a rear portion of refrigerating room 200. The cool air which flows into feeding duct 26 through fan 24 is supplied into refrigerating room 200 through feeding ports 28. Preferably, additional feeding ports 29 which are communicated with feeding duct 26 may be installed on opposite side walls of refrigerating room 200.

Meanwhile, a heat insulating member 41 which is intended to maintain a temperature difference between freezing room 100 and refrigerating room 200 surrounds the upper, lower, left, right and back sides of the refrigerator and is also provided between freezing room 100 and refrigerating room 200.

A supply duct 42 for the air curtain is formed under heat insulating member 41 provided between freezing room 100 and refrigerating room 200 and consists of a fan receiving portion **42*a* for receiving a fan 44 for the air curtain, a horizontal portion 42*b*, a curved portion 42*c* having a predetermined curvature, and a straight portion 42*d* leaning to the door for refrigerating room 200 by a predetermined angle θ with respect to a vertical line. A supply port for the air curtain 43 has a slit shape and is provided adjacent to a door of refrigerating room 200 at a top portion of refrigerating room 200. Preferably, supply port 43 may be formed over the overall width of refrigerating room 200. Since supply duct 42 has the leaning straight portion 42*d*, the injected cool air therethrough is directed not to a straight lower direction, but to a lower direction leaning to the door for refrigerating room 200** by the predetermined angle θ with respect to a vertical line. Preferably, θ is 5° to 20°, and more preferably, 10° to 15°.

Figure 1:
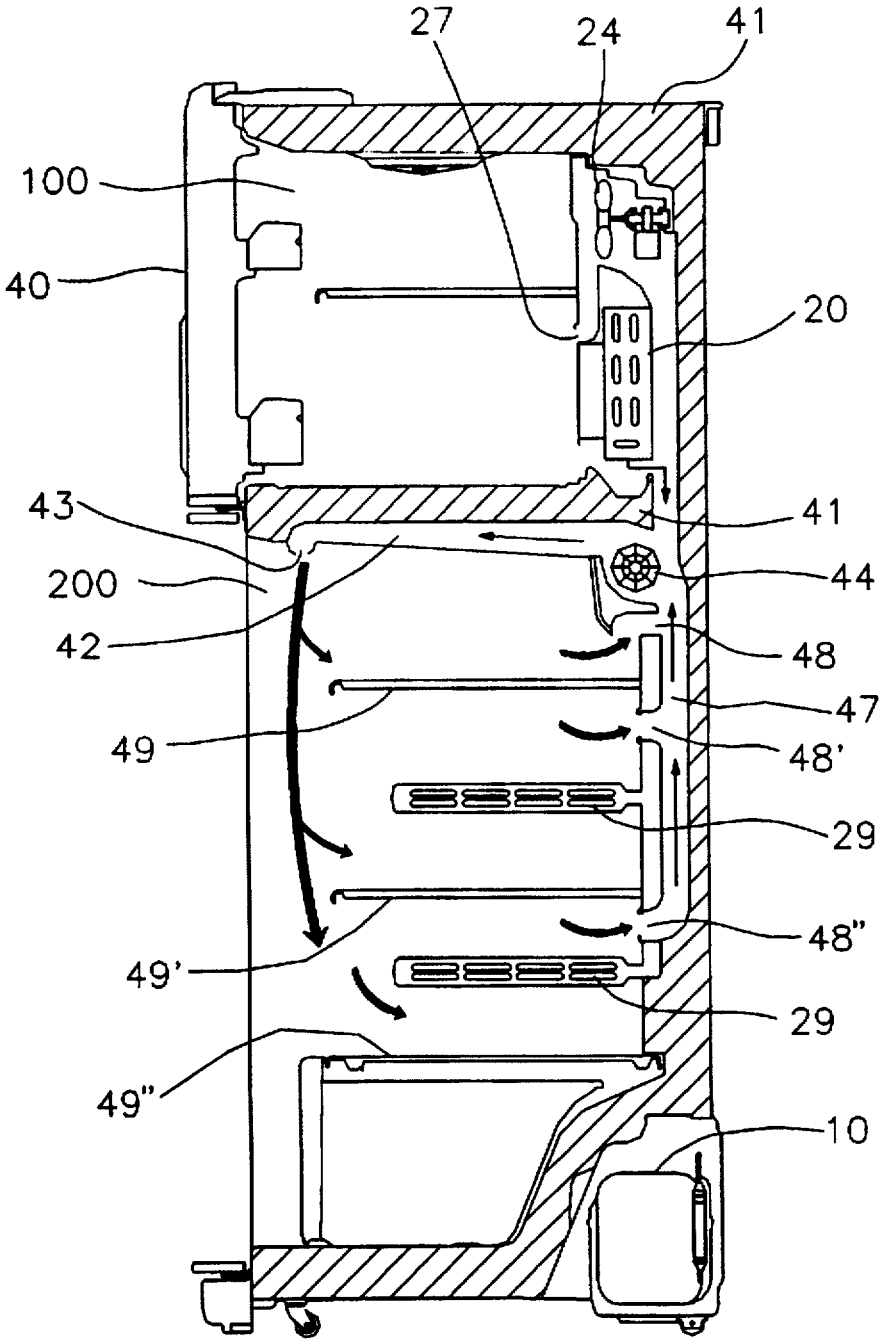
FIG. 1 is a longitudinal side sectional view showing the internal structure of a refrigerator according to the present invention under the open condition of a door for a refrigerating room.

As shown in FIG. 1, fan 44 for the air curtain is installed adjacent to a rear portion of the refrigerator within fan receiving portion **42*a*. To form a laminar flow, fan 44 should be a crossflow fan. Preferably, crossflow fan 44 may have a length equal to the inner width of refrigerating room 200. Crossflow fan 44 is driven by an additional motor 46**.

A lower surface of supply duct 42 is inclined at a predetermined angle, so that the cross sectional area of supply duct 42 is gradually decreased toward supply port 43. As a result, a laminar flow is generated in which the air flow passing adjacent to an upper surface of supply duct 42 is faster than that passing adjacent to the lower surface of supply duct 42. The length of arrows shown in FIG. 3 represents the flow speed. Alternatively, in order to promote the effect, one or more steps may be formed on the lower surface of supply duct 42, and a member having greater surface roughness may be used for the lower surface of supply duct 42. Supply duct 42 having the lower surface provided with two steps is shown in FIG. 3.

Curved portion **42*c* of supply duct 42 has the predetermined curvature to transmit to straight portion 42*d* the laminar flow which is formed in horizontal portion 42*b* and consists of air flows with the speed difference between them. Straight portion 42*d* of supply duct 42 is provided for the straightness of the injected air curtain, and supply port 43 is formed at the terminal end of straight portion 42*d***.

Supply duct 42 is communicated with a suction duct 47 for sucking the cool air within refrigerating room 200. In other words, the refrigerator according to the present invention is not provided with an additional suction duct and additional suction ports which are for the air curtain but utilizes suction duct 47 and suction ports 48, 48' and 48" which are for circulation of the cool air. Suction duct 47 extends vertically along a center portion of the rear of the refrigerator. Suction ports 48, 48' and 48" are allotted for accommodating spaces within refrigerating room 200, respectively. In the embodiment, upper, middle and lower accommodating spaces are provided. Preferably, the sectional area of suction port 48 allotted for the upper accommodating space is smaller than that of suction port 48' allotted for the middle accommodating space, while the sectional area of suction port 48' is smaller than that of suction port 48" allotted for the lower accommodating space.

The accommodating spaces of refrigerating room 200 are defined by shelves 49, 49' and 49". The upper surface of shelves 49, 49' and 49" may be flat in order to smoothly suck the injected cool air for the air curtain. Terminal ends of shelves 49 and 49' adjacent to the door for refrigerating room 200 are located to be retracted from supply port 43 for the air curtain toward the rear portion of the refrigerator, and terminal ends of shelves 49, 49' and 49" opposite to terminal ends thereof adjacent to the door are closely coupled with the inner rear wall of refrigerating room 200. Meanwhile, a terminal end of shelf 49" adjacent to the door is located to be projected from supply port 43 toward the door.

Suction ports 48, 48' and 48" within the accommodating spaces are provided to have a predetermined height from the shelf, the height being determined by considering the amount of food to be stored, and preferably, are provided above a half position from the shelf in height. Suction ports 48, 48' and 48" may be shaped as a rectangle or an ellipse having the longer dimension along a width direction of the refrigerator.

Hereinafter, the function and effect of the present invention will be described.

When the door for refrigerating room 200 is opened, crossflow fan 44 starts to be driven. If fan 24 for circulating the cool air is on being driven, the drive of fan 24 is stopped at the time of opening the door for refrigerating room 200. Through supply port 43 for the air curtain, the cool air is injected in response to the drive of fan 44 to form the air curtain. By the formation of the air curtain, the temperature within refrigerating room 200 does not increase drastically because the air curtain prevents the cool air within refrigerating room 200 from flowing out.

The laminar flow generated by crossflow fan 44 passes through supply duct 42 for the air curtain and is transformed to a laminar flow which consists of air flows with the speed difference therebetween in horizontal portion **42*b*. The laminar flow having the speed difference is injected downwardly passing through curved portion 42*c*, straight portion 42*d* and supply port 43. Straight portion 42*d* is formed to lean to the door at the predetermined angle θ with respect to a vertical line, so that the air curtain is injected with the lean at the predetermined angle θ. Supply port 43** has a slit shape in order to supply a relatively thin air curtain.

The injecting speed of the air curtain is determined so that the critical point at which the injected air flows diverge drastically can be located at the lower accommodating space of the refrigerating room, wherein the injecting speed is the speed of the highest injected air flow.

The sectional area of the respective horizontal, curved and straight portions **42*b*, 42*c* and 42*d* of supply duct 42** for the air curtain is determined so that the flow resistance is low, which results in suppression of the generation of the turbulent flow components such as vortex and eddy.

Because of the relative generating position of the critical point, the inside air flows of the air curtain having a relatively low speed are L-shaped curved at the upper or middle accommodating space of refrigerating room 200, while the most outside air flow of the air curtain having the highest speed is L-shaped curved at the lower accommodating space of refrigerating room 200. The main driving force of the curve of the injected air flows is the suction force of air through suction ports 48, 48' and 48", the suction force being generated by the operation of fan 44 for the air curtain. In FIG. 1, the trace of the injected air flows are shown by arrows. When the inside air flows of the air curtain having a relative low speed are curved, the outside air flow thereof having a relative high speed are forced to be directed into refrigerating room 200 by the viscosity of air. Consequently, the outside air flows are prevented from being directed to the exterior of refrigerating room 200. To accompany the effect, the speed difference between the inside and outside air flows is determined so that the air flows are not separated from one another after injection.

Preferably, suction port 48 provided at the upper accommodating space of refrigerating room 200 has the narrower sectional area than suction port 48' provided at the middle accommodating space, and suction port 48' has the narrower sectional area than suction port 48" provided at the lower accommodating space. Therefore, the injected air flows undergo the gradually increasing suction force with their progress, so that the L-shaded curve of the injected air flows is ensured.

When the door for refrigerating room 200 is closed, the drive of fan 44 stops. If the temperature of refrigerating room 200 is above a preset temperature, the cooling system of the refrigerator operates.

Figure 4:
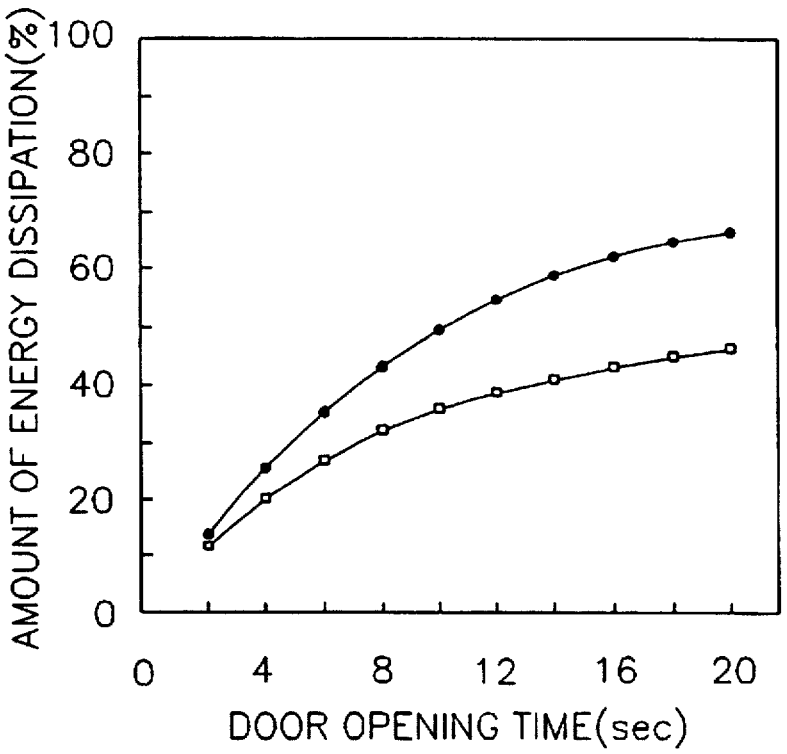
FIG. 4 is a graph showing the relationship between the door opening time and the amount of energy dissipation in the refrigerator of the present invention and a conventional refrigerator.
Figure 5:
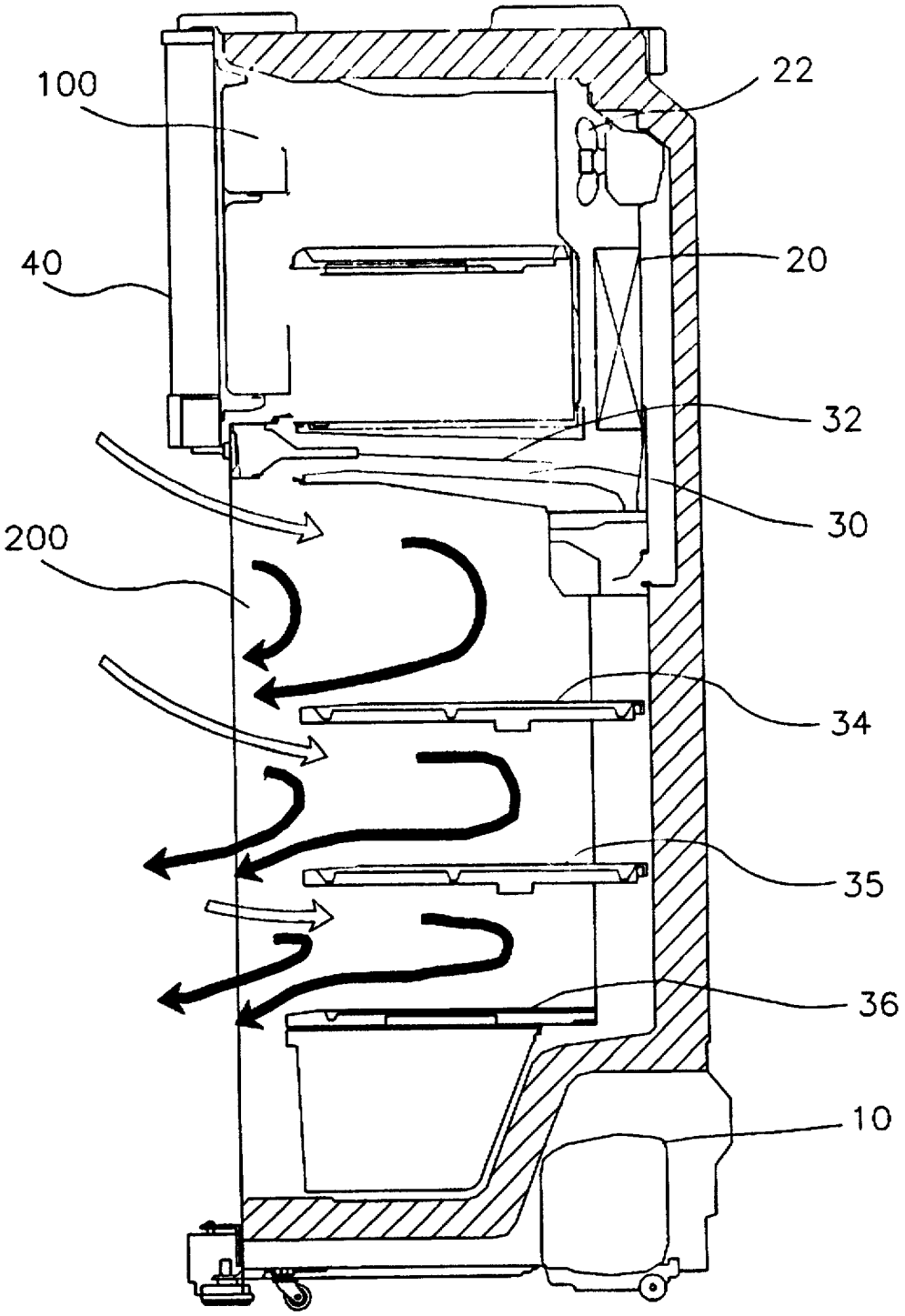
FIG.5 PRIOR ART
FIG. 5 is a longitudinal side sectional view showing the internal structure of the conventional refrigerator.
Figure 6:
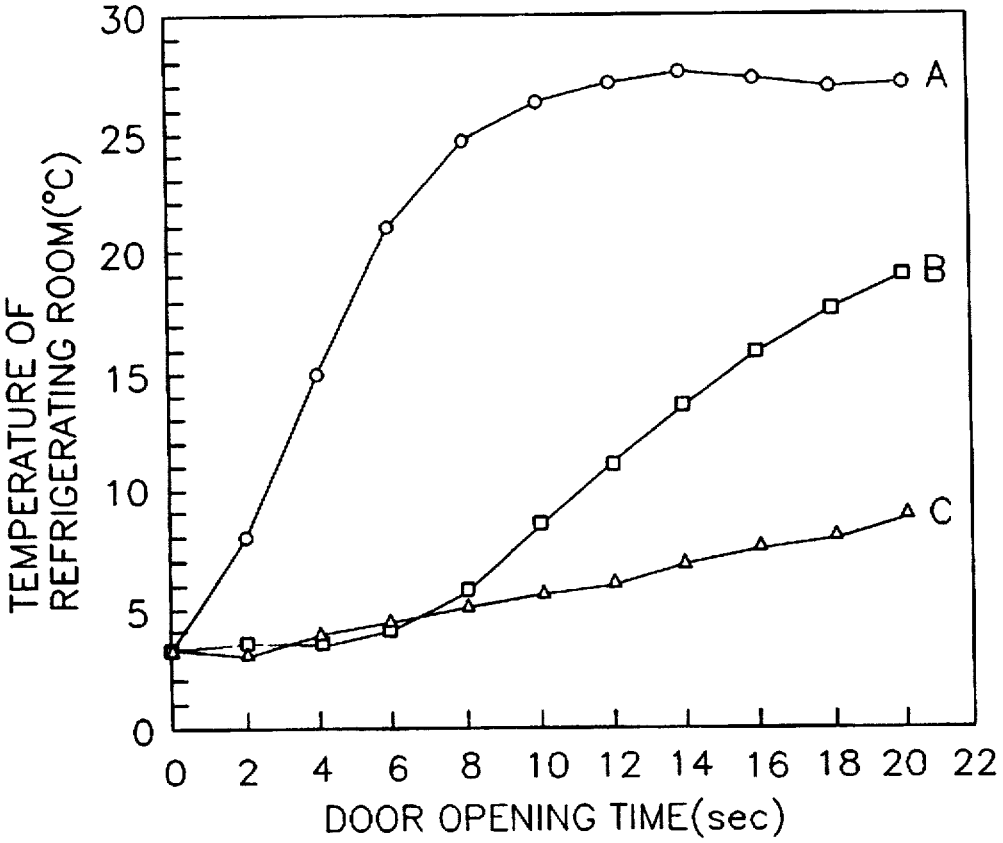
FIG. 6 PRIOR ART
FIG. 6 is a graph showing the relationship between the door opening time and the temperature of a refrigerating room in the conventional refrigerator.

FIG. 4 is a graph showing the relationship between the door opening time and the amount of energy dissipation in the refrigerator of the present invention and a conventional refrigerator. A curved line dotted by solid points is for the conventional refrigerator, and a curved line dotted by blank points is for the refrigerator of the present invention. As shown, after 10 seconds from the opening of the door, the energy within the refrigerating room dissipates about 50% in the conventional refrigerator, while about 35% in the refrigerator of the present invention.

While the present invention has been particularly shown and described with reference to preferred embodiment thereof, it will be understood by those skilled in the art that various changes in form and details may be effected therein without departing from the spirit and scope of the invention as defined by the appended claims.

What is claimed is:

1. A refrigerator comprising:

a freezing room;

a refrigerating room;

producing means for producing cool air;

circulating means for circulating the cool air in said freezing room and said refrigerating room, including a feeding duct provided with at least one feeding port, a suction duct provided with at least one suction port and a fan member; and generating means for generating an air curtain in said refrigerating room, said generating means comprising:

a supply duct for the air curtain, including a supply port installed adjacent to a door of said refrigerating room to downwardly inject air flows for the air curtain therethrough, being installed at an uppermost portion within said refrigerating room to extend from a rear portion of said refrigerating room to a front portion thereof, and being communicated with said suction duct; and a crossflow fan for the air curtain, installed within said supply duct to generate the air flows and being operated to be driven at the time of opening of said door and stop at the time of closing of said door, wherein said injected air flows for the air curtain are sucked through said suction port and said suction duct.

2. The refrigerator as claimed in claim 1, wherein said crossflow fan has a length substantially equal to the inner width of said refrigerating room.

3. The refrigerator as claimed in claim 1, wherein said crossflow fan for the air curtain is installed adjacent to the rear portion of said refrigerating room.

4. The refrigerator as claimed in claim 1, wherein the sectional area of said supply duct is gradually decreased toward said supply port from a portion of said supply duct receiving said crossflow fan for the air curtain therein.

5. The refrigerator as claimed in claim 1, wherein said supply port has a slit shape, and the length of said supply port is substantially equal to the inner width of said refrigerating room.

6. The refrigerator as claimed in claim 1, wherein said supply duct consists of a fan receiving portion for receiving said crossflow fan for the air curtain, a horizontal portion extending adjacent to a front side of said refrigerating room from said fan receiving portion, a curved portion being curved downwardly to have a predetermined curvature and extending from said horizontal portion, and a straight portion extending from said curved portion to ensure the straightness of the air curtain, a terminal end of said straight portion forming said supply port.

7. The refrigerator as claimed in claim 6, wherein said horizontal portion of said supply duct includes an upper horizontal flat portion and a lower inclined flat portion.

8. The refrigerator as claimed in claim 7, wherein said lower inclined flat portion is provided with at least one step thereon.

9. The refrigerator as claimed in claim 7, wherein the surface roughness of said lower inclined flat portion is greater than that of said upper horizontal flat portion.

10. The refrigerator as claimed in claim 6, wherein said straight portion of said supply duct is formed to lean to the the outside of said refrigerator at a predetermined angle with respect to a vertical line.

11. The refrigerator as claimed in claim 10, wherein the predetermined angle is 5° to 20°.

12. A refrigerator comprising:

a freezing room;

a refrigerating room;

producing means for producing cool air;

circulating means for circulating the cool air in said freezing room and said refrigerating room, including a feeding duct provided with at least one feeding port, a suction duct provided with at least one suction port which is formed at a rear side of said refrigerating room and a fan member; and generating means for generating an air curtain in said refrigerating room, said generating means comprising:

a supply duct for the air curtain, including a supply port installed adjacent to a door of said refrigerating room to downwardly inject air flows for the air curtain therethrough, being installed at an uppermost portion within said refrigerating room to extend from a rear portion of said refrigerating room to a front portion thereof, and being communicated with said suction duct, said supply port being of a slit shape extending along a width direction of said refrigerating room; and a fan member for the air curtain, installed within said supply duct to generate the air flows and being operated to be driven at the time of opening of said door and stop at the time of closing of said door, wherein at least one shelf is installed in said refrigerating room, and the sectional area of said suction port allotted for the respective accommodating spaces which are divided by said shelf is determined so that the sectional area of said suction port allotted for a lower accommodating space is broader than that of said suction port allotted for an upper accommodating space; and wherein said injected air flows for the air curtain are sucked through said suction port and said suction duct.

13. The refrigerator as claimed in claim 12, wherein said fan member for the air curtain is a crossflow fan, and said crossflow fan has a length substantially equal to the inner width of said refrigerating room.

14. The refrigerator as claimed in claim 12, wherein said fan member for the air curtain is installed adjacent to the rear portion of said refrigerating room.

15. The refrigerator as claimed in claim 12, wherein the sectional area of said supply duct is gradually decreased toward said supply port from a portion of said supply duct receiving said fan member for the air curtain therein.

16. The refrigerator as claimed in claim 12, wherein said supply duct consists of a fan receiving portion for receiving said fan member for the air curtain, a horizontal portion extending adjacent to a front side of said refrigerating room from said fan receiving portion, a curved portion being curved downwardly to have a predetermined curvature and extending from said horizontal portion, and a straight portion extending from said curved portion to ensure the straightness of the air curtain, a terminal end of said straight portion forming said supply port.

17. The refrigerator as claimed in claim 16, wherein said horizontal portion of said supply duct includes an upper horizontal flat portion and a lower inclined flat portion.

18. The refrigerator as claimed in claim 17, wherein said lower inclined flat portion is provided with at least one step thereon.

19. The refrigerator as claimed in claim 17, wherein the surface roughness of said lower inclined flat portion is greater than that of said upper horizontal flat portion.

20. The refrigerator as claimed in claim 17, wherein said straight portion of said supply duct is formed to lean to the the outside of said refrigerator at a predetermined angle with respect to a vertical line.

21. The refrigerator as claimed in claim 20, wherein the predetermined angle is 5° to 20°.

22. The refrigerator as claimed in claim 12, wherein a terminal end, adjacent to said door, of the lowest shelf installed within said refrigerating room is located to be projected from the installing position of said supply port toward said door, while terminal ends, adjacent to said door, of the other shelves are located to be retracted from the installing position into said refrigerating room.

23. The refrigerator as claimed in claim 12, wherein said suction duct extends vertically along a center portion of the rear side of said refrigerator and is directly communicated with said refrigerating room through said suction port.

24. A refrigerator comprising:

a freezing room;

a refrigerating room;

producing means for producing cool air;

circulating means for circulating the cool air in said freezing room and said refrigerating room, including a feeding duct provided with at least one feeding port, a suction duct provided with at least one suction port which is formed at a rear side of said refrigerating room and a fan member; and generating means for generating an air curtain in said refrigerating room, said generating means comprising:

a supply duct for the air curtain, including a supply port installed adjacent to a door of said refrigerating room to downwardly inject air flows for the air curtain therethrough, being installed at an uppermost portion within said refrigerating room to extend from a rear portion of said refrigerating room to a front portion thereof, and being communicated with said suction duct, said supply port being of a slit shape extending along a width direction of said refrigerating room; and a fan member for the air curtain, installed within said supply duct to generate the air flows and being operated to be driven at the time of opening of said door and stop at the time of closing of said door, wherein at least one shelf is installed in said refrigerating room, and the sectional area of said suction port allotted for the respective accommodating spaces which are divided by said shelf is determined so that the sectional area of said suction port allotted for a lower accommodating space is broader than that of said suction port allotted for an upper accommodating space;

wherein said injected air flows for the air curtain are sucked through said suction port and said suction duct;

wherein said fan member for the air curtain is a crossflow fan, and said crossflow fan has a length substantially equal to the inner width of said refrigerating room;

wherein said fan member for the air curtain is installed adjacent to the rear portion of said refrigerating room;

wherein the sectional area of said supply duct is gradually decreased toward said supply port from a portion of said supply duct receiving said fan member for the air curtain therein;

wherein said supply duct consists of a fan receiving portion for receiving said fan member for the air curtain, a horizontal portion extending adjacent to a front side of said refrigerating room from said fan receiving portion, a curved portion being curved downwardly to have a predetermined curvature and extending from said horizontal portion, and a straight portion extending from said curved portion to ensure the straightness of the air curtain, a terminal end of said straight portion forming said supply port;

wherein said horizontal portion of said supply duct includes an upper horizontal flat portion and a lower inclined flat portion;

wherein said lower inclined flat portion is provided with at least one step thereon;

wherein said straight portion of said supply duct is formed to lean to the outside of said refrigerator by 5° to 20° with respect to a vertical line;

wherein a terminal end, adjacent to said door, of the lowest shelf installed within said refrigerating room is located to be projected from the installing position of said supply port toward said door, while terminal ends, adjacent to said door, of the other shelves are located to be retracted from the installing position into said refrigerating room; and wherein said suction duct extends vertically along a center portion of the rear side of said refrigerator and is directly communicated with said refrigerating room through said suction port.

* * * * *